US008943614B2

(12) United States Patent
Salinas

(10) Patent No.: US 8,943,614 B2
(45) Date of Patent: Feb. 3, 2015

(54) PRIVACY GARMENT SYSTEM

(76) Inventor: Shiree D. Salinas, Mission, TX (US)

( * ) Notice: Subject to any disclaimer, the term of this patent is extended or adjusted under 35 U.S.C. 154(b) by 166 days.

(21) Appl. No.: 13/620,694

(22) Filed: Sep. 14, 2012

(65) Prior Publication Data

US 2014/0075642 A1 Mar. 20, 2014

(51) Int. Cl.
*A41D 3/06* (2006.01)

(52) U.S. Cl.
USPC ..... 2/87; 2/209.13

(58) Field of Classification Search
CPC ..... A41D 2200/20; A41D 3/00; A41D 3/05; A41D 3/08; A41D 3/02; A41D 3/04; A41D 15/00; A41D 15/04; A41D 2400/422; A47K 11/02; A47K 11/045; A42B 1/004; A42B 1/006; A42B 1/24; A42B 1/18; A42B 1/241; A42B 1/048; A42B 1/064; A42B 1/008; A42B 1/067; A42B 1/068; A42B 5/00; A45F 4/12; A45F 5/02
USPC ..... 2/84–89, 209.11–209.13
See application file for complete search history.

(56) References Cited

U.S. PATENT DOCUMENTS

| | | | |
|---|---|---|---|
| 484,945 | A | 10/1892 | Aldrich |
| 1,599,798 | A | 9/1926 | Stockton |
| 2,275,693 | A | 3/1942 | Soboroff |
| 2,295,826 | A | 9/1942 | Bray |
| 3,188,654 | A | 6/1965 | Rafowitz et al. |
| 3,358,292 | A | 12/1967 | Bonk et al. |
| 4,064,562 | A | 12/1977 | Kenny |
| 4,486,903 | A | 12/1984 | Krystal |
| 4,845,782 | A | 7/1989 | Gregg |
| 4,980,928 | A | 1/1991 | Ellis |
| 5,459,881 | A | 10/1995 | Fagan et al. |
| 5,623,732 | A | 4/1997 | Olajide, Jr. |
| 5,649,327 | A | 7/1997 | Crewe |
| 5,694,648 | A | 12/1997 | Nucifora |
| 5,887,287 | A | 3/1999 | Potochnik |
| 5,933,871 | A | 8/1999 | Kraft |
| 5,996,124 | A | 12/1999 | Asp, Jr. |
| 6,049,911 | A | 4/2000 | Bromberg |
| 6,131,201 | A | 10/2000 | Chu |
| 6,233,738 | B1 * | 5/2001 | Siracusa ..... 2/4 |
| 6,564,387 | B1 * | 5/2003 | Willoughby ..... 2/69 |
| 6,789,268 | B2 | 9/2004 | Yan |
| 6,802,083 | B2 | 10/2004 | Yan |
| 6,892,398 | B2 | 5/2005 | Wilson |
| 6,996,852 | B1 | 2/2006 | Cabrera |
| 7,020,900 | B2 | 4/2006 | Ngan |

(Continued)

FOREIGN PATENT DOCUMENTS

| | | | |
|---|---|---|---|
| DE | 4040442 | A1 | 6/1992 |
| EP | 1743534 | A2 | 1/2007 |
| EP | 1743534 | A3 | 6/2008 |

*Primary Examiner* — Andrew W Collins
(74) *Attorney, Agent, or Firm* — Gunn, Lee + Cave, P.C.

(57) ABSTRACT

A privacy garment system comprising a coat having an inner surface defining an inner volume, an outer surface, a first end, a second end, and opposing joinable seam ends extending between said first end and said second end and defining a front section. The embodiment further comprises a hat fastenable to the first end of said coat, which hat has a crown with an inner surface defining a head volume, an outer surface, and a pocket formed between said inner surface and said outer surface. The coat may be configured into a compact state having a coat volume that is less than the pocket volume for storage or transport.

4 Claims, 8 Drawing Sheets

(56) References Cited

U.S. PATENT DOCUMENTS

| | | | |
|---|---|---|---|
| 7,107,625 | B2 | 9/2006 | St-Germain |
| D532,185 | S | 11/2006 | St-Germain |
| 7,240,372 | B2 | 7/2007 | Larson |
| 2006/0021110 | A1 | 2/2006 | Lunzer et al. |
| 2006/0143773 | A1 | 7/2006 | Danilova |
| 2006/0174398 | A1 | 8/2006 | Proctor |
| 2007/0130669 | A1 | 6/2007 | Rogers |
| 2011/0004992 | A1 | 1/2011 | Navarre |

* cited by examiner

PRIVACY GARMENT SYSTEM

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND

1. Field of the Invention

The present invention relates to a garment system. More specifically, the present invention is a privacy garment system for isolating a user from the elements and providing privacy when engaging in outdoor activities, such as camping or hiking scenarios.

2. Description of the Related Art

Privacy in an outdoor group setting can be difficult to achieve in a convenient manner. In a large group, any time one person needs to urinate or defecate, the remainder of the group must either wait while that person moves further away from the group for the sake of privacy and courtesy, or leave the person behind. To complicate matters, the more people involved in the activity, the more frequently such needs may arise and the greater the potential for interference with any currently-ongoing activities. Moreover, finding a suitable outdoor location for such functions can be challenging, especially in dark, adverse, and uncomfortable situations.

BRIEF SUMMARY

The present invention is a garment system that provides at least some privacy when the wearer needs to urinate or defecate while engaged in outdoor activities such as camping and hiking In addition, the system provides a barrier to the elements in an outdoor setting. The present invention allows for a continuation of outdoor group activities—namely, there is no need to cut activities short because someone needs to use the restroom, because the wearer need not go far from the group or camp in order to perform the necessary bodily functions outside of the view of the wearer's companions. When not needed, the coat may be stored in a pocket formed in the hat of the system. Additionally, one embodiment provides for a cushioned sleeping environment.

One embodiment of the system comprises a coat having an inner surface defining an inner volume, an outer surface, a first end, a second end, and opposing joinable seam ends extending between said first end and said second end and defining a front section. The embodiment further comprises a hat fastenable to the first end of said coat, which hat has a crown with an inner surface defining a head volume, an outer surface, and a pocket formed between said inner surface of said hat and said outer surface of said hat. The coat may be configured into a compact state having a coat volume that is less than the pocket volume for storage or transport.

DETAILED DESCRIPTION OF VARIOUS EMBODIMENTS

Figure 1:
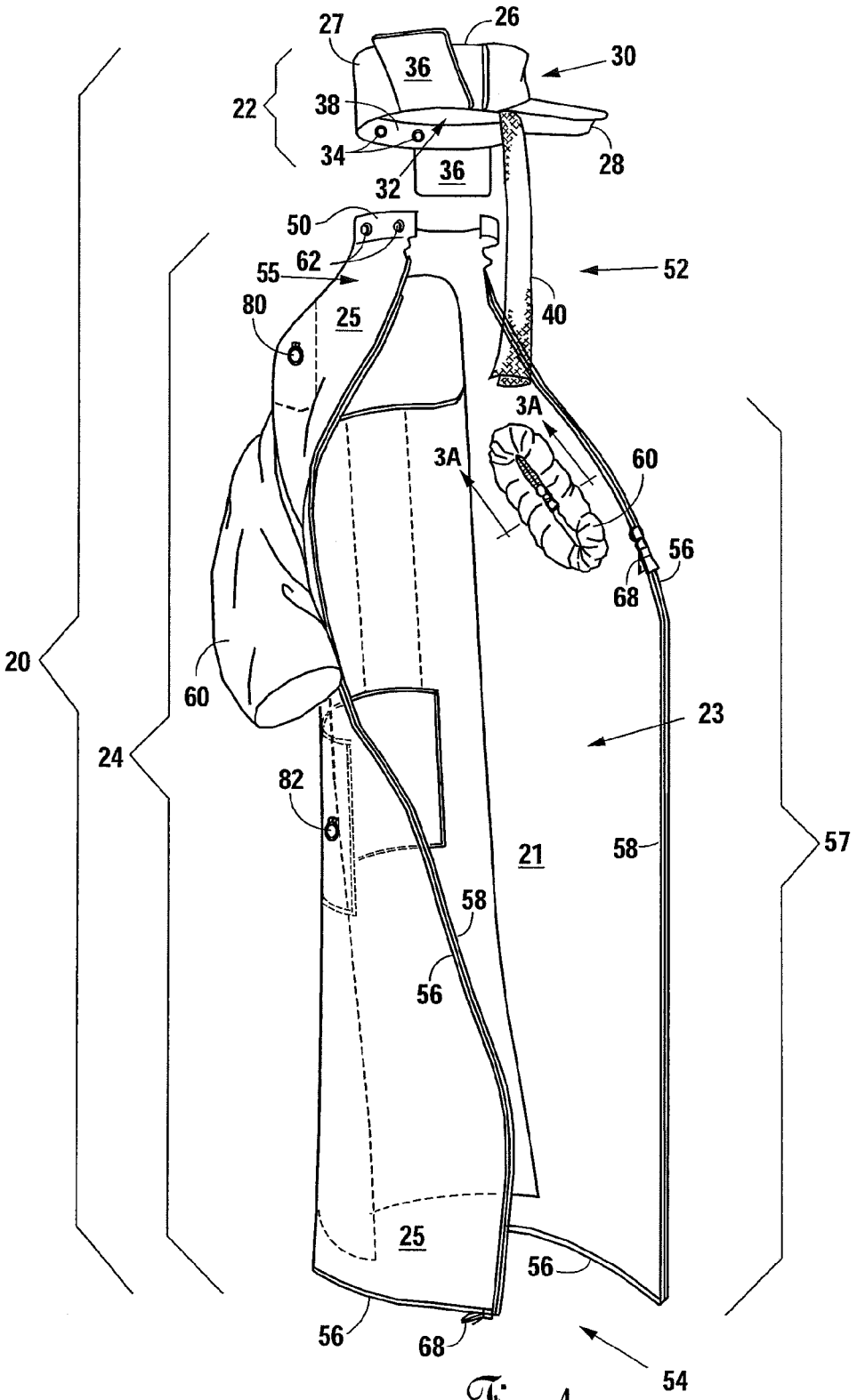
FIG. 1 shows an embodiment of the present invention.

FIG. 1 shows a first embodiment 20 of a system having the features of the present invention. The embodiment 20 includes a hat 22 and a coat 24. The hat 22 is in the form of a cap having a crown 26 and a visor 28 extending from a front section 30 of the crown 26. The crown 26 has an outer surface 27 and defines a head volume 32. Pockets 36 are attached to the outer surface 27 of the crown 26. Elastic gathering 38 is positioned near the boundary of the head volume 32. A number of first fastening members 34 protrude through the elastic gathering 38 into the head volume 32. A mesh panel 40 is connected to the front section 30 of the crown 26 and is extendable toward the coat 24 to a position anterior of the wearer's face. The crown 26 is formed of a heavy, water-resistant cloth material.

Figure 2:
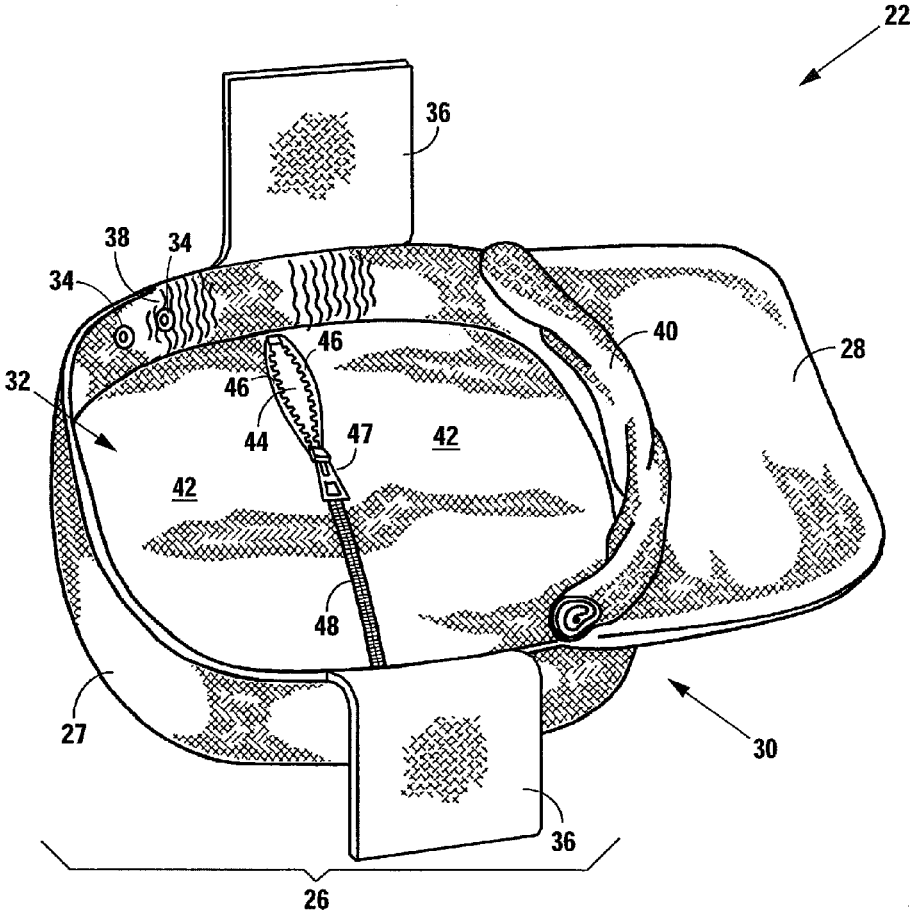
FIG. 2 shows the hat of the embodiment described with reference to FIG. 1.

As shown in FIG. 2, the crown 26 of the hat 22 includes an inner surface 42 that defines the head volume 32. Each pocket 36 is attached (e.g., sewn) to the outer surface 27 of the crown 26. The mesh panel 40 is attached (e.g., sewn) to the front section 30 of the crown 26 and is in a rolled-up configuration.

A pocket 44 is formed between the inner surface 42 and outer surface 27 of the crown 26. Zipper teeth 46 are positioned along edges 48 forming the opening into the pocket 44, and may be joined with a slider 47. Although in this embodiment access to the pocket 44 is through an opening in the inner surface 42, in other embodiments, access to the pocket 44 may be through the outer surface 27 instead of, or in addition to, the inner surface 42.

Referring back to FIG. 1, the coat 24 is preferably an overcoat, but may be a topcoat, other subtype of coat, or cloak. The coat 24 has an inner surface 21 defining a variably sizable inner volume 23, and an outer surface 25. The coat 24 has a first end 52, and a second end 54. The coat includes a narrow head portion 55 and a body portion 57. A rim 50 is located proximal to the first end 52 and terminates the head portion 55.

The coat 24 further includes a selectively closable seam with seam ends 56 extending between the first and second ends 52, 54. Fastening means, such as zipper teeth 58 and sliders 68, are attached at or near the seam ends 56 and at the second end 54. Sleeves 60 are sewn to the inner surface 21 and extend through lateral openings 59 (see FIG. 3B), although alternative embodiments contemplate the sleeves 60 being removably attached to the inner surface 21, such as with hook-and-loop material.

As compared with the material composing the crown 26 of the hat 22, the coat 24 (including the sleeves 60) is made of a thin, water-resistant, lightweight material, such as nylon. The coat 24 can be folded and contained within the pocket 44 of the hat 22 (see FIG. 2) for easy storage and transport.

The rim 50 includes second fastening members 62 that are engagable with the first fastening members 34 of the hat 22. In the preferred embodiment, the first and second fastening members 34, 62 are female and male portions, respectively, of stud buttons, allowing the hat 24 to be fastened around the rim 50, with the rim 50 positioned in the head volume 32. Alternative fastening means may include zippers, hook-and-loop material, or other similar fastening means.

Figure 3A:
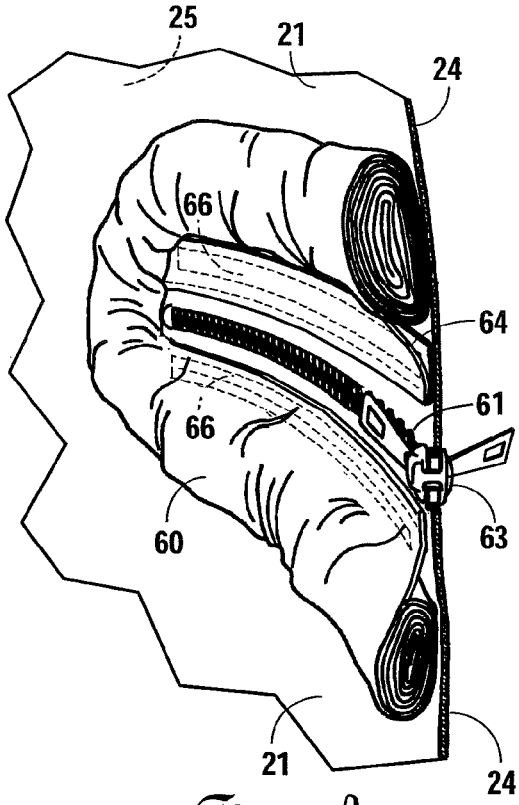
FIG. 3A is a sectional view through line 3A-3A of FIG. 1.
Figure 3B:
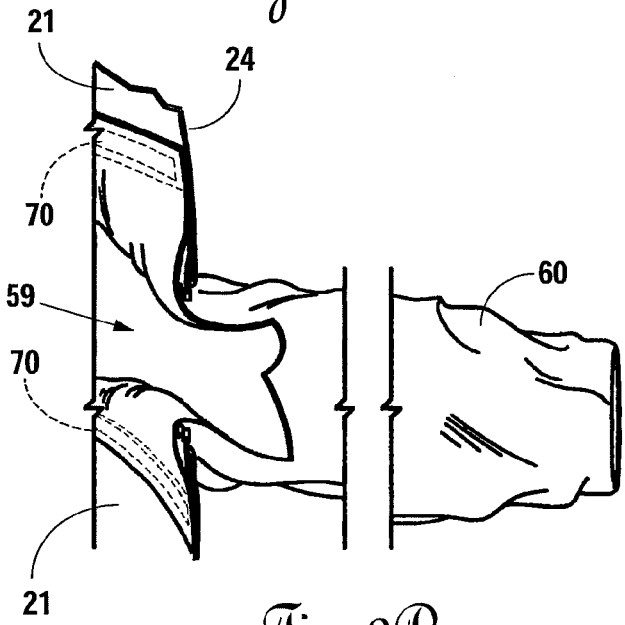
FIG. 3B is the same view as FIG. 3A with the sleeve in an extended position.

As shown in FIGS. 3A-3B, each sleeve 60 may be configured in a rolled or an unrolled configuration. FIG. 3A shows a sleeve 60 in a rolled configuration and sealed against the surrounding environment with zipper teeth 61 and slider 63. The zipper teeth 61 are attached to sides of the lateral opening 59 extending between the inner and outer surfaces 21, 25 of the coat 24. The slider 63 may be used to selectively close the lateral opening 59. FIG. 3B shows the sleeve 60 of FIG. 3A in an unrolled configuration extending through the lateral opening 59. The end of the sleeve 60 is attached to the inner surface 21 of the coat 24. The sleeve 60 extends through the lateral opening 59.

Figure 4:
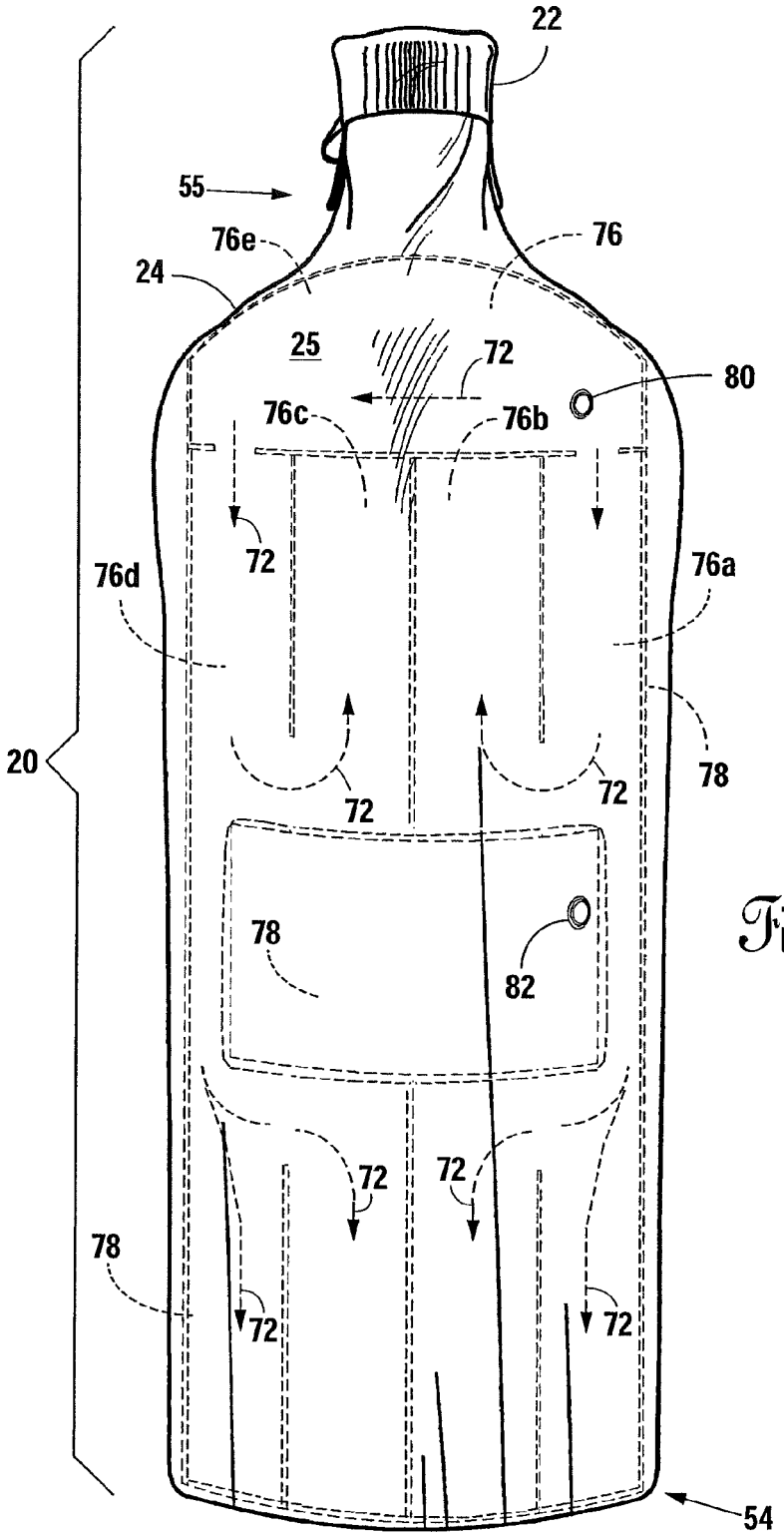
FIG. 4 is a rear elevation of the embodiment.

Referring to FIG. 4, a first fluid chamber 76 is formed between the inner surface 21 and outer surface 25 of the coat 24. The first fluid chamber 76 extends substantially along the length of the coat 24 between the head portion 55 and the second end 54 of the coat 24. The first fluid chamber is subdivided into multiple interconnected sub-chambers 76*a*-76*e*. A first nozzle 80 provides a selectively openable fluid communication path with the first fluid chamber 76, for which air 72 may flow into the sub-chambers 76*a*-76*e*.

A second fluid chamber 78 is surrounded by the first fluid chamber 76 and is positioned approximately equidistantly between the head portion 55 and the second end 54 of the coat 24. A second nozzle 82 provides a selectively openable fluid communication path with the second fluid chamber 78.

Figure 5:
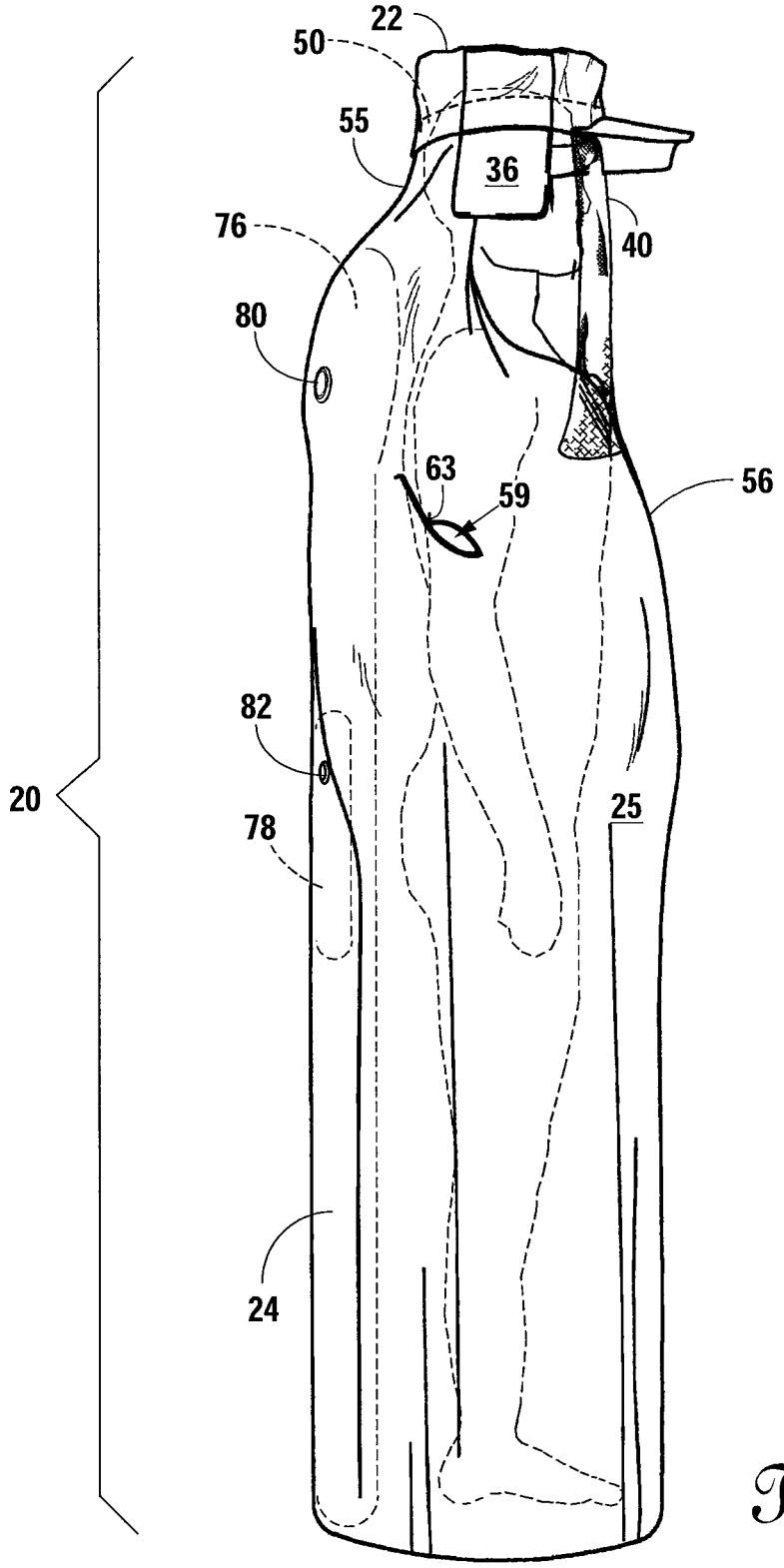
FIG. 5 shows the embodiment described with reference to FIGS. 1-4 in use.

As shown in FIG. 5, when used, the embodiment 20 allows a wearer to be substantially isolated from the surrounding elements. The embodiment 20 further provides a degree of privacy to the wearer. In this configuration, the zipper slider 68 is drawn the length (or substantially the length) of the coat 24 joining the seam ends 56. Sleeves (not shown) are in the rolled up configuration described with reference to FIG. 3A, with sleeve sliders 63 closing the lateral openings 59. The hat 22 is fastened to the rim 50 with the first and second fastening members 34, 62. The mesh panel 40 is extended past the head portion 55 to cover the wearer's face, neck, and upper chest, and may be attached to the coat 24 with hook-and-loop material or similar fastening means. Pockets 36, which may be used for storage while also protecting the lateral surfaces of the wearer's head from weather, are in a lowered positioned. First and second fluid chambers 76, 78 have been filled with air through first and second nozzles 80, 82 to at least substantially-inflated states. Although the embodiment is described as having a hat 22 being fastenable to the rim 50 with fastening members 34, 62 proximal to the boundary of the head volume 32, alternative embodiments contemplate the hat being fastened to the coat contained within the pocket 44.

In the event the wearer desires privacy, such as in the case of the need to urinate or defecate, by moving a relatively short distance from the wearer's companions, the wearer may still perform these sensitive bodily functions in privacy, and without the need for a substantial break in activity to allow the wearer to find a private area that may be further away.

Figure 6:
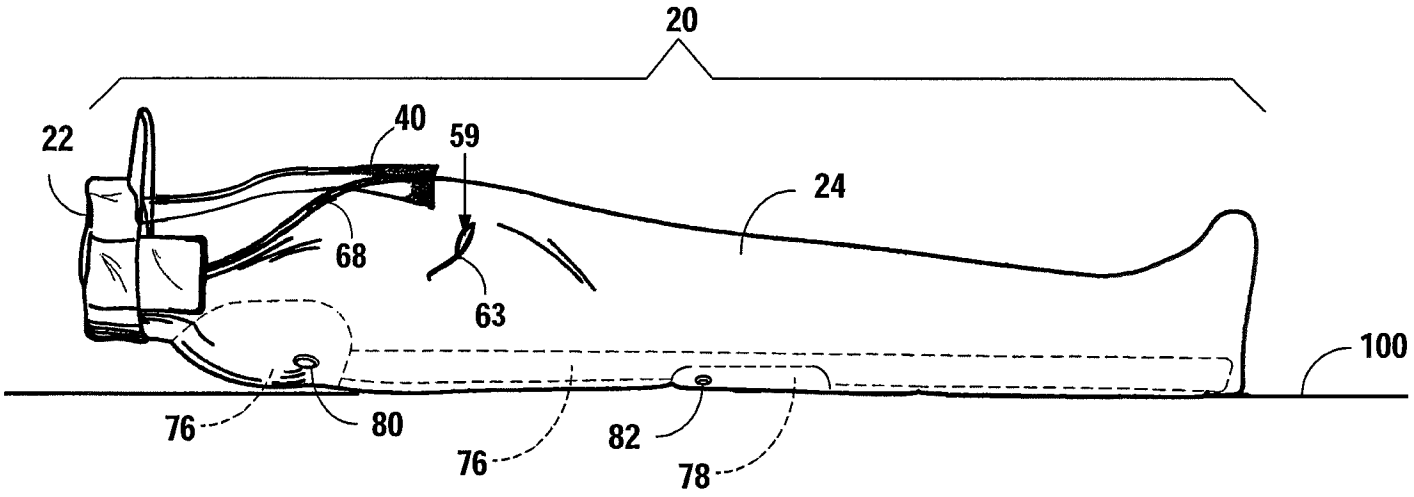
FIG. 6 shows the embodiment described with reference to FIGS. 1-5 in use as a sleeping device.

As shown in FIG. 6, the embodiment 20 also increases comfort to the wearer when in a supine position. In this position, first and second fluid chambers 76, 78 act as an air mattress to increase the comfort to the wearer when resting on a ground surface 100. The wearer may maintain a substantially isolated state from the surrounding environment by wearing the hat 22, extending the mesh panel 40, and closing the front seam and second end 54 of the coat 24 with the zipper sliders 68 and sleeve sliders 63 in closed states. In addition, the wearer may inflate only the second fluid chamber 78 to use as seating cushion, such as in a stadium or concert environment.

Figure 7:
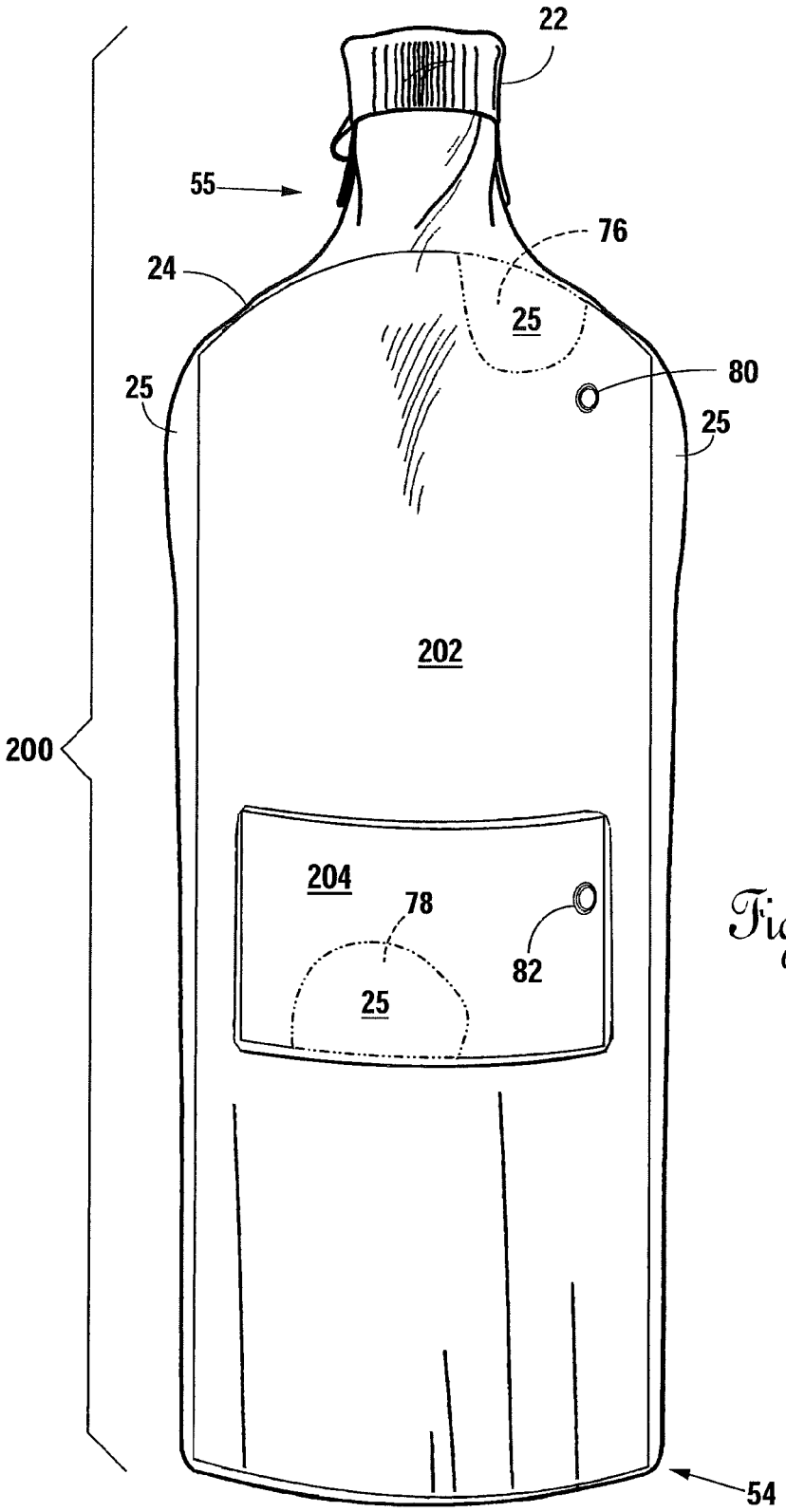
FIGS. 7-8 show an alternative embodiment of the invention.
Figure 8:
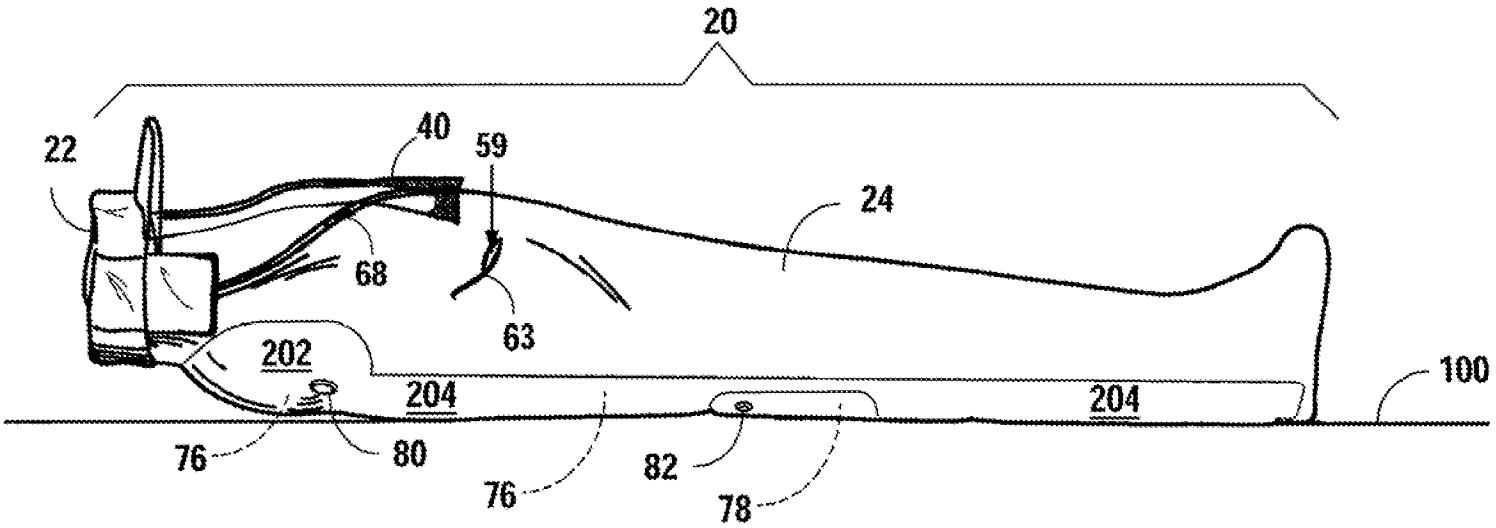

FIG. 7-8 show a second embodiment 200 of the invention, which is identical in all respects to the first embodiment 20 described with reference to FIGS. 1-6, except that the first and second fluid chambers 76, 78 are formed by sealing separate fluid-impermeable sheets 202, 204 of material to the outer surface 25 of the coat 24 to contain any fluids introduced into the chambers 76, 78 through the first and second nozzles 80, 82, respectively. Thus, in this second embodiment 200, the first and second fluid chambers 76, 78 are defined by the first and second sheets 202, 204 and the outer surface 25 of the coat 24. In yet another embodiment, the first and second chambers 76, 78 may be separately formed and attached to the outer surface 25 of the coat 24.

The present invention is described in terms of preferred embodiment in which a specific system is described. Those skilled in the art will recognize that alternative embodiments of such a system can be used in carrying out the present invention. Other aspects and advantages of the present invention may be obtained from a study of this disclosure and the drawings, along with the appended claims.

I claim:

1. A privacy garment system comprising:

a coat having an inner surface defining an inner volume, an outer surface, a first end, a second end, and opposing joinable seam ends extending between said first end and said second end and defining a front section;

a hat removably fastenable to said first end of said coat, said hat having a crown with an inner surface defining a head volume, an outer surface, and a pocket having a pocket volume formed between said inner surface of said hat and said outer surface of said hat;

a first zipper attached to said opposing joinable seam ends for closing said opposing joinable seam ends;

a second zipper attached to said second end of said coat;

a mesh panel attached to a front section of said hat; and wherein said coat is configurable into a compact state having a coat volume less than the pocket volume such that when said coat is stored within said pocket volume said coat is contained wholly within said pocket volume;

at least one fluid chamber having a plurality of interconnected subchambers and positioned opposite the front section of said coat; and at least one nozzle providing a selectively closable fluid communication path into said at least one fluid chamber;

wherein said at least one fluid chamber comprises a first fluid chamber substantially extending between said second end of said coat and said first end of said coat;

wherein said at leas tone fluid chamber comprises a second fluid chamber positioned approximately equidistantly between said first end of said coat and said second end of said coat, and wherein said second fluid chamber is surrounded by said first fluid chamber.

2. The system of claim 1 wherein said at least one fluid chamber is formed between said inner surface of said coat and said outer surface of said coat.

3. The system of claim 1 further comprising at least one sheet of fluid-impermeable material attached to the outer surface of said coat to form at least one fluid chamber.

4. The system of claim 1 wherein said coat has opposing selectively closable lateral openings extending between said inner surface of said coat and said outer surface of said coat, and further comprises sleeves attachable to said inner surface of said coat and selectively extendable and retractable through said lateral openings.

* * * * *